US010224650B2

(12) United States Patent
Shen et al.

(10) Patent No.: US 10,224,650 B2
(45) Date of Patent: Mar. 5, 2019

(54) COAXIAL FREQUENCY-SEPARATING CONNECTOR

(71) Applicant: Grand-Tek Technology Co., Ltd., New Taipei (TW)

(72) Inventors: Kung-Yu Shen, New Taipei (TW); Ta-Lun Lee, New Taipei (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/859,034

(22) Filed: Dec. 29, 2017

(65) Prior Publication Data

US 2018/0294583 A1 Oct. 11, 2018

(30) Foreign Application Priority Data

Apr. 11, 2017 (TW) ..... 106112092 A

(51) Int. Cl.

| | |
|---|---|
| ***H01R 9/05*** | (2006.01) |
| ***H01R 24/50*** | (2011.01) |
| ***H01P 5/02*** | (2006.01) |
| *H01R 103/00* | (2006.01) |

(52) U.S. Cl.

CPC ..... *H01R 9/0521* (2013.01); *H01P 5/026* (2013.01); *H01R 9/0503* (2013.01); *H01R 24/50* (2013.01); *H01R 2103/00* (2013.01)

(58) Field of Classification Search

CPC ..... H01R 2103/00; H01R 9/0521; H01R 13/5208

USPC ..... 439/63, 578–585, 587, 620.03

See application file for complete search history.

(56) References Cited

U.S. PATENT DOCUMENTS

| | | | | |
|---|---|---|---|---|
| 6,019,622 | A * | 2/2000 | Takahashi | H01R 24/46 200/51.1 |
| 6,238,218 | B1 * | 5/2001 | Baffert | H01R 24/50 439/581 |
| 7,186,144 | B1 * | 3/2007 | Khemakhem | H01R 13/6658 439/581 |
| 7,262,672 | B2 * | 8/2007 | Lee | H01R 24/44 333/260 |
| 7,278,887 | B1 * | 10/2007 | Palinkas | H01R 13/719 439/620.03 |
| 7,306,484 | B1 * | 12/2007 | Mahoney | H01R 24/542 439/578 |

(Continued)

*Primary Examiner* — Thanh Tam Le

(74) *Attorney, Agent, or Firm* — Muncy, Geissler, Olds & Lowe, P.C.

(57) ABSTRACT

A coaxial frequency-separating connector of the present invention applies a first conducting element to receive a multi-frequency signal from a multi-frequency transmission element, and applies a multi-frequency dividing circuit to divide the multi-frequency signal to a plurality of different frequency signals such that the different frequency signals are respectively transmitted to the first coaxial cable and the second coaxial cable of a second conducting element. Furthermore, a first frequency contacting end to which a first RF element is connected and a second frequency contacting end to which a second RF element is connected are respectively connected on one end of the first coaxial cable and one end of the second coaxial cable. Accordingly, two RF elements with two different frequency bands can use only one coaxial frequency-separating connector to connect to a transmission element.

12 Claims, 4 Drawing Sheets

(56) References Cited

U.S. PATENT DOCUMENTS

| | | | | |
|---|---|---|---|---|
| 7,442,084 | B2 * | 10/2008 | Montena | H01R 13/5202 333/185 |
| 7,540,773 | B2 * | 6/2009 | Ko | H01R 13/5808 439/581 |
| 7,621,753 | B1 * | 11/2009 | Pai | H01R 13/6205 439/39 |
| 7,753,689 | B1 * | 7/2010 | Wu | H01R 13/648 439/490 |
| 8,366,482 | B2 * | 2/2013 | Burris | H01R 9/0521 439/584 |
| 8,961,223 | B2 * | 2/2015 | Daughtry, Jr. | H01R 9/05 439/578 |
| 8,975,520 | B2 * | 3/2015 | Blake | H01R 13/6658 174/74 R |

* cited by examiner

COAXIAL FREQUENCY-SEPARATING CONNECTOR

FIELD OF THE INVENTION

The present invention relates to a connector, and more particularly relates to a coaxial frequency-separating connector able to perform a frequency dividing operation.

BACKGROUND OF THE INVENTION

With the development of the Internet, communication devices, such as switches, modems and routers, have been wildly developing. Due to a large amount of signal transmission, a communication device usually configured with a plurality of board-type RF components on a circuit board to receive signals having respective different frequencies on one frequency band and then to add the signals together so as to increase the signal transmitting amount on one frequency band. However, the board-type RF component on the circuit board is an electronic component with small size such that it is with comparatively poor signal quality. Therefore, an extra transmission component such as a coaxial cable or an antenna is required to externally connect to the board-type RF component for strengthening the transmitting signal. A coaxial connector is therefore provided to connect the board-type RF component with the transmission component in such a manner that the coaxial connector is connected between the board-type RF component and a casing of the communication device to which a transmission component is connected.

However, with the development of communication devices, communication devices have been evolved from using a single frequency band to multiple frequency bands for data transmission in recent years, such that a dual-frequency band communication device that can transmit and receive signals in two frequency bands is available today. In practice, such dual-frequency band communication device requires two board-type RF components on the circuit board for two frequency bands, and accordingly at least two coaxial connectors on the casing are required. However, the space of the casing for receiving the coaxial connectors is limited such that the casing is not able to accommodate as many as more than two coaxial connectors.

SUMMARY OF THE INVENTION

In view of the above, one drawback of the conventional coaxial connector in a prior art is that a casing of communication device has insufficient accommodation for receiving as many amount as more than two coaxial connectors. Therefore, an improvement is required.

Accordingly, one of the objectives of the present invention is to provide a coaxial frequency-separating connector allowing the commutation device to reduce the amount of coaxial connector to solve the space problem for installing the coaxial connectors.

Therefore, the present invention overcomes the technical problems in the conventional art and provides a coaxial frequency-separating connector, comprising: a sleeve element having a through hole space inside; a first conducting element fastened and disposed in the through hole space, a front end of the first conducting element being conductively connected to a multi-frequency transmission element; a frequency dividing element fastened and disposed in the through hole space and conductively connected to a rear end of the first conducting element, the frequency dividing element including a multi-frequency contacting end, a multi-frequency dividing circuit, a first frequency contacting end and a second frequency contacting end, one end of the multi-frequency dividing circuit being connected to the multi-frequency contacting end, the other end of the multi-frequency dividing circuit being branched to connect to both the first frequency contacting end and the second frequency contacting end so as to perform a signal transfer between frequency combining and frequency dividing for the multi-frequency contacting end in relation to the first frequency contacting end and the second frequency contacting end; and a second conducting element including a first coaxial cable and a second coaxial cable, one end of the first coaxial cable being connected to the first frequency contacting end, a first frequency connector being provided at the other end of the first coaxial cable, one end of the second coaxial cable being connected to the second frequency contacting end, and a second frequency connector being provided at the other end of the second coaxial cable.

According to an embodiment of the present invention, the frequency of the first frequency contacting end and the frequency of the second frequency contacting end are 2.4 GHz and 5 GHz, respectively.

According to an embodiment of the present invention, both front ends of the first conducting element and the sleeve element are formed with a universal RF connector selected one from a group comprising SMA, PR-SMA, Type-N-female, and PR-TNL-female connectors.

According to an embodiment of the present invention, a threaded portion is formed on an external surface of a front end of the sleeve element.

According to an embodiment of the present invention, both the first frequency connector and the second frequency connector are board-side connectors selected from SMP, MCX, MMCX, U.FL, I-PEX and Mini-coaxial connectors.

According to an embodiment of the present invention, a front cushion and a rear retainer are provided on an external surface of a rear end of the sleeve element, the front cushion protruding in an axial direction of the sleeve element on a rear external surface of the sleeve element, the rear retainer being removable disposed at the sleeve element in a position relatively behind the front cushion, and a slot being formed between the front cushion and the rear retainer for pressing against a casing of a communication device so as to fix the sleeve element on the casing.

According to an embodiment of the present invention, the front end of the first conducting element is a connecting terminal that conducts a frequency signal to a dual-frequency antenna.

In summary, the coaxial frequency-separating connector of the present invention applies a first conducting element to receive a multi-frequency signal from a multi-frequency transmission element, and applies a multi-frequency dividing circuit to divide the multi-frequency signal to a plurality of different frequency signals such that the different frequency signals are respectively transmitted to the first coaxial cable and the second coaxial cable of a second conducting element. Furthermore, a first frequency contacting end to which a first RF element is connected and a second frequency contacting end to which a second RF element is connected are respectively connected on one end of the first coaxial cable and one end of the second coaxial cable. Accordingly, two RF elements with two different frequency bands can use only one coaxial frequency-separating connector to connect to a transmission element. Therefore, the amount that the coaxial frequency-separating connector needed to be installed in a communication device is less. It therefore avoids the interference among/between the coaxial frequency-separating connector.

DETAILED DESCRIPTION OF THE PREFERRED EMBODIMENTS

The preferred embodiments of the present invention are described in detail below with reference to FIG. 1 to FIG. 4. The description is used for explaining the embodiments of the present invention only, but not for limiting the scope of the claims.

Figure 1:
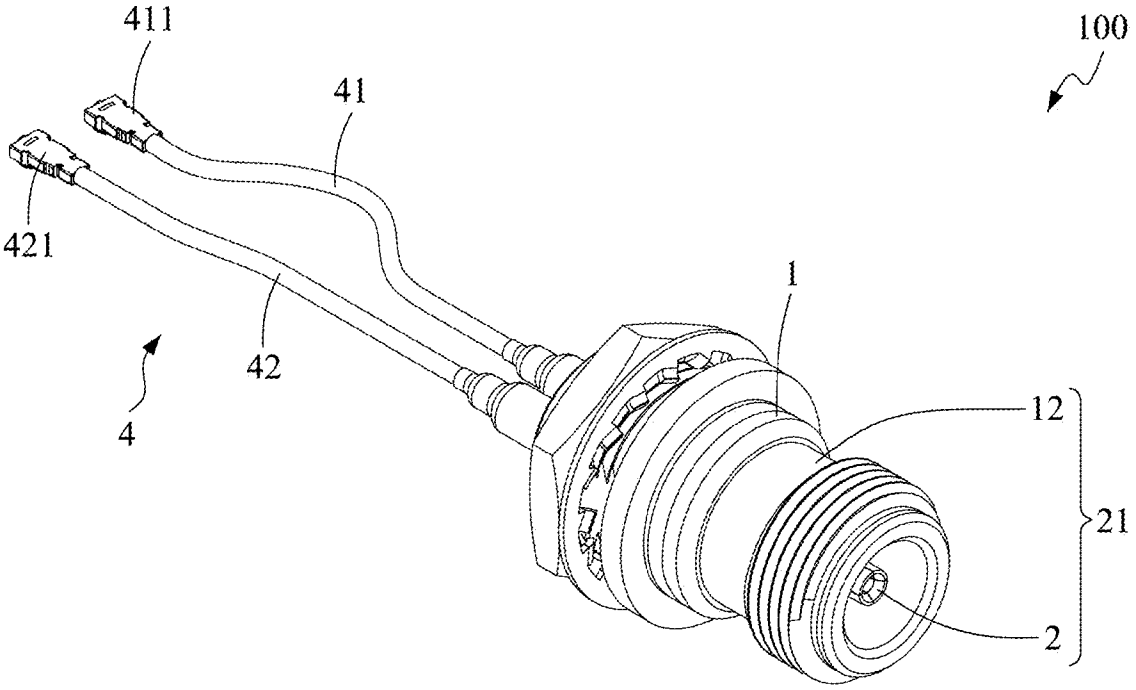
FIG. 1 is a schematic stereogram illustrating a coaxial frequency-separating connector according to one embodiment of the present invention.
Figure 2:
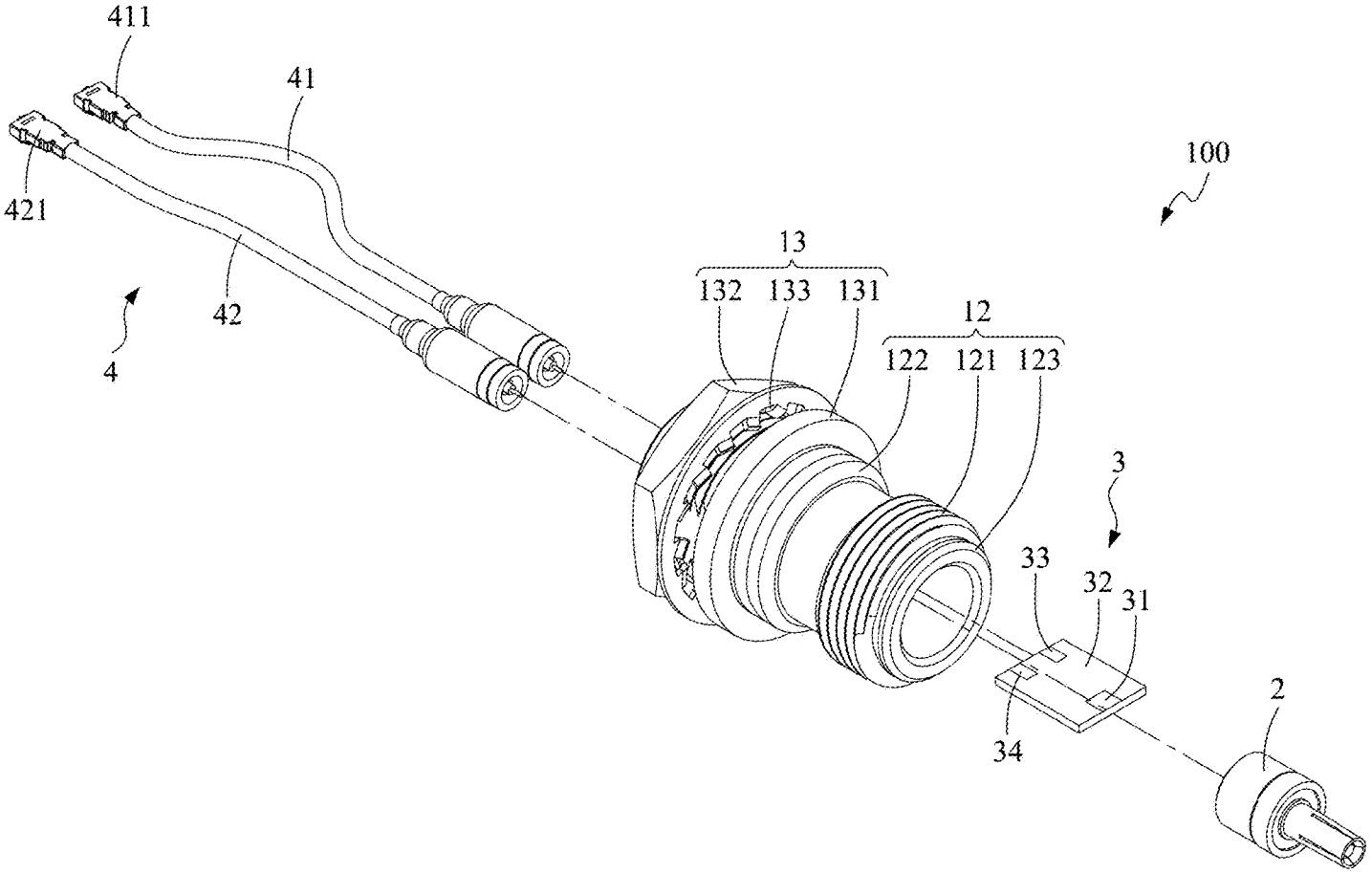
FIG. 2 is an exploded view illustrating a coaxial frequency-separating connector according to the embodiment of the present invention.
Figure 3:
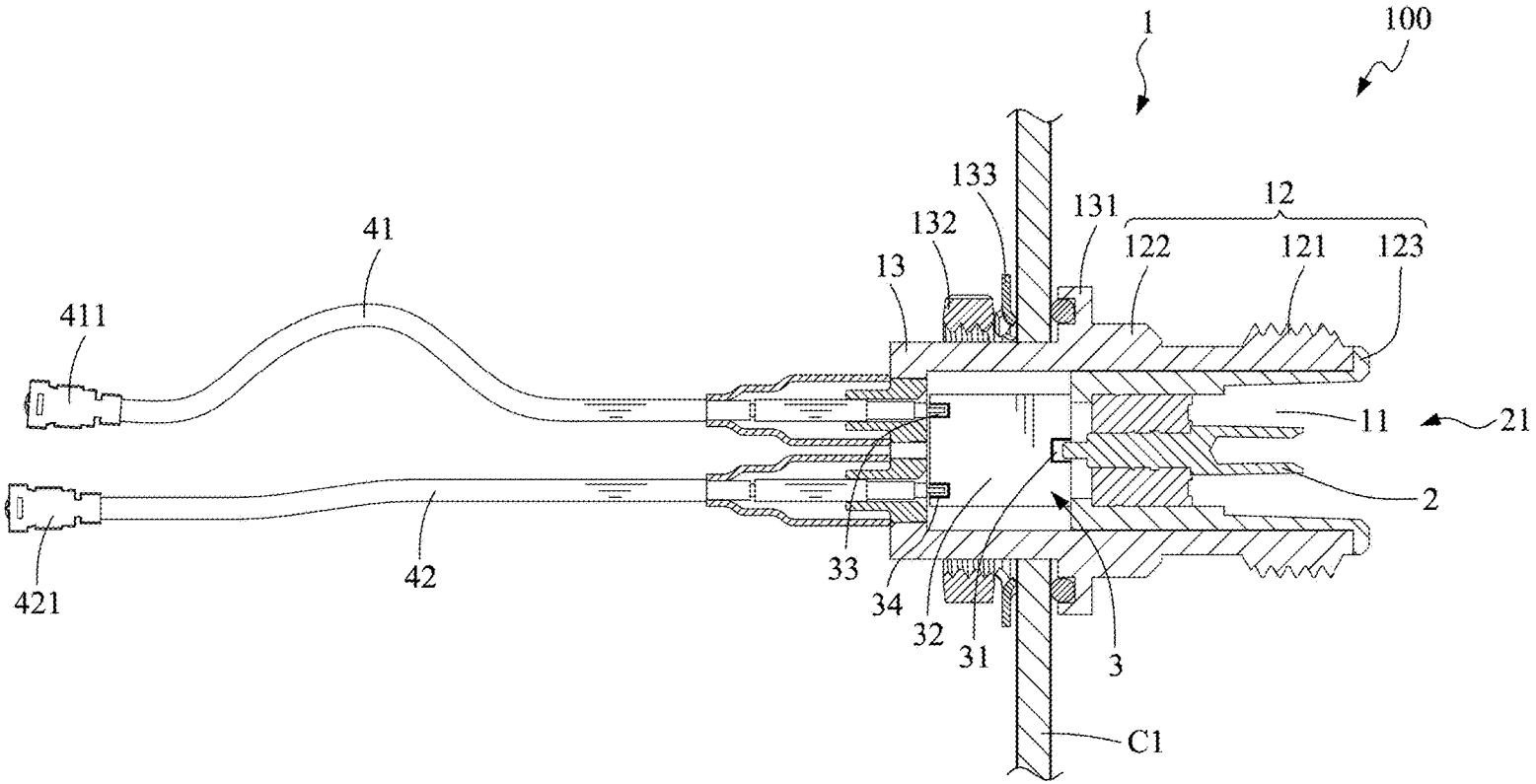
FIG. 3 is a cross-section view illustrating a coaxial frequency-separating connector according to the embodiment of the present invention.
Figure 4:
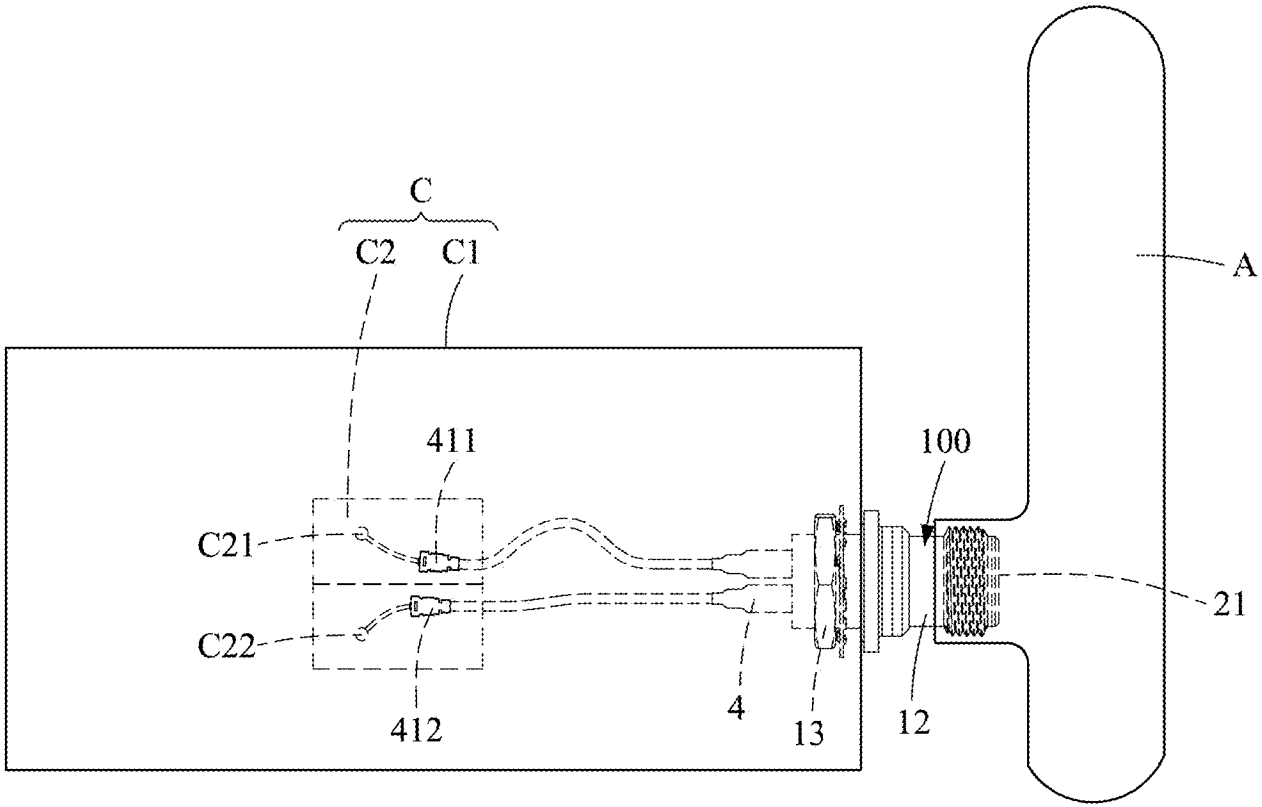
FIG. 4 is a schematic drawing illustrating a coaxial frequency-separating connector in use according to the embodiment of the present invention.

As shown in FIG. 1 to FIG. 3, a coaxial frequency-separating connector 100 according to one embodiment of the present invention includes: a sleeve element 1, a first conducting element 2, a frequency dividing element 3 and a second conducting element 4. As shown in FIG. 4, one end of the coaxial frequency-separating connector 100 is connected to a multi-frequency transmission element A, and the other end is installed on a casing C1 of a communication device C in a manner that signals are branched to connect to a first RF element C21 and a second RF element C22 on a PCB C2 of the communication device C. However, the present invention is not limited to this and the coaxial frequency-separating connector 100 may be applied to connect between any electronic communication components such as coaxial cables, RF elements, and RF antennas.

As shown in FIG. 1 to FIG. 3, the sleeve element 1 has a through hole space 11 inside. In the embodiment, the sleeve element 1 covers the outer surface of the first conducting element 2 and the frequency dividing element 3 so as to protect the first conducting element 2 and the frequency dividing element 3 by disposing them inside the through hole space 11.

The front end of the sleeve element 1 is formed with a transmission sleeve 12 for connecting to the multi-frequency transmission element A (a dual-frequency antenna element). Preferably, a threaded portion 121 is provided on the external surface of the transmission sleeve 12 for fastening the corresponding multi-frequency transmission element A. Moreover, a stopper 122 may be added to the transmission sleeve 12 for stopping the multi-frequency transmission element A.

A communication sleeve 13 is formed on the rear end of the sleeve element 1 for installing the communication device C. Preferably, a front cushion 131 and a rear retainer 132 are provided on the external surface of the communication sleeve 13. The front cushion 131 protrudes in an axial direction of the communication sleeve 13 and the rear retainer 132 is removable disposed at the sleeve element 1 in a position relatively behind the front cushion 131. In the embodiment, the rear retainer 132 is a nut fastened to the thread on the external surface of the communication sleeve 13 such that a slot is formed between the front cushion 131 and the rear retainer 132. The sleeve element 1 is connected by inserting the communication sleeve 13 into an installing opening on the casing C1 of the communication device C and using the front cushion 131 to remain on the external surface of the casing C1. The rear retainer 132 can be rotated relatively to a corresponding threaded portion to move toward and press against the internal surface of the casing C1 such that the slot is firmly fastened on the casing C1 so as to fix the sleeve element 1 on the casing C1. Preferably, a waterproof cushion can be provided in between the front cushion 131 and the casing C1 such that the front cushion can be more affixed to the casing and prevent water from entering the installing opening of a casing, as shown in FIG. 3. Preferably, a washer 133 may be added in between the rear retainer 132 and the casing C1 to further fasten the casing C1, as shown in FIG. 3.

As shown in FIG. 1 to FIG. 3, the first conducting element 2 is fastened and disposed in the through hole space 11, However, the present invention is not limited to this and the first conducting element 2 may be disposed partially outside the through hole space 11. The first conducting element 2 has a conducting pin disposed at the center of the transmission sleeve 12, the front end of conducting pin used to conductively connect a conductor inside the multi-frequency transmission element A. Preferably, a universal RF connector 21 is formed by the front end of the conducting pin in the first conducting element 2 and the transmission sleeve 12. In the embodiment of the present invention, the universal RF connector 21 is formed by the transmission sleeve 12 and an internal sleeve 123. However, the present invention is not limited to this and the transmission sleeve 12 can be connected to other multi-frequency transmission element A in other manners. The universal RF connector 21 is one selected from a group comprising SMA, PR-SMA, Type-N-female, and PR-TNL-female connectors corresponding to the multi-frequency transmission element A such that the universal RF connector 21 can be directly installed in and connected to the multi-frequency transmission element A. However, the present invention is not limited to this and other types of connectors or a directly conductive connection without connectors can also be applied to connect the multi-frequency transmission element A. In the embodiment of the present invention, the universal RF connector 21 is a Type-N-female connector that can directly conductively connect a contacting end of a dual-frequency antenna.

As shown in FIG. 1 to FIG. 3, the frequency dividing element 3 is a frequency division PCB fastened and disposed at the through hole space 11 inside communication sleeve 13 behind the first conducting element 2. The frequency dividing element 3 includes a multi-frequency contacting end 31, a first frequency contacting end 33 and second frequency contacting end 34. The multi-frequency contacting end 31 is disposed in the front end of the PCB and the first frequency contacting end 33 and the second frequency contacting end 34 are respectively disposed in the rear end of the PCB. A multi-frequency dividing circuit 32, disposed in the middle of the PCB, is connected between the multi-frequency contacting end 31, the first frequency contacting end 33, and second frequency contacting end 34. The multi-frequency contacting end 31 is connected to the rear end of the conducting pin of the first conducting element 2. The multi-frequency dividing circuit 32 is a complicated multi-frequency dividing circuit configured to perform a signal transfer between frequency combining and frequency dividing for the multi-frequency contacting end 31 in relation to the first frequency contacting end 33 and the second frequency contacting end 34 so as to divide the multi-frequency from the first conducting element 2 into first frequency and second frequency via the multi-frequency dividing circuit. Preferably, the multi-frequency dividing circuit 32 is used to perform a frequency dividing operation between multi-frequency, 2.4 GHz and 5 GHz. The frequency of the first frequency contacting end 33 and the frequency of the second frequency contacting end 34 are 2.4 GHz, and 5 GHz, which are the commonly used frequencies.

As shown in FIG. 1 to FIG. 3, the second conducting element 4 includes a first coaxial cable 41 and a second coaxial cable 42. In the embodiment of the present invention, one end of the first coaxial cable 41 applies a contacting end to conductively connect to the first frequency contacting end 33 and is embedded in one installing opening of the rear end of sleeve element 1. A first frequency connector 411 is provided at the other end of the first coaxial cable 41. One end of the second coaxial cable 42 applies a contacting end to conductively connect to the second frequency contacting end 34 and is embedded in one another installing opening of the rear end of sleeve element 1. A second frequency connector 421 is provided at the other end of the second coaxial cable 42. Preferably, in the embodiment of the present invention, both the first frequency connector 411 and the second frequency connector 421 are board-side connectors selected from a group comprising SMP, MCX, MMCX, U.FL, I-PEX and Mini-coaxial connectors, which can be connected to the corresponding first RF element and second RF element. However, the present invention is not limited to this and the conductor inside the cable of the first frequency connector 411 and the second frequency connector 421 can also be used as connectors. The conductor can be welded directly to the first RF element C21 and the second RF element C22 on the PCB C2 of the communication device C. The conductor can also applies the other type of connectors to connect to the first RF element C21 and the second RF element C22 on the PCB C2 of the communication device C.

With the structure described above, it can be seen that the coaxial frequency-separating connector 100 applies the first conducting element 2 to receive a multi-frequency signal from a multi-frequency transmission element A, and applies a multi-frequency dividing circuit 3 to divide the multi-frequency signal to a plurality of different frequency signals such that the different frequency signals are respectively transmitted to the first coaxial cable 41 and the second coaxial cable 42 of a second conducting element 4. Furthermore, a first frequency contacting end 33 to which a first RF element C21 is connected and a second frequency contacting end 34 to which a second RF element C22 is connected are respectively connected on one end of the first coaxial cable 41 and one end of the second coaxial cable 42. Accordingly, two RF elements with two different frequency bands can use only one coaxial frequency-separating connector 100 to connect to a transmission element. Therefore, the amount that the coaxial frequency-separating connectors 100 needed to be installed in a communication device C is less and the transmission speed of the RF elements in two frequency bands is faster.

The above description is only an explanation of the preferred embodiments of the present invention. One having ordinary skill in the art can make various modifications according to the above description and the claims defined below. However, those modifications shall still fall within the scope of the present invention.

What is claimed is:

1. A coaxial frequency-separating connector, comprising:

a sleeve element having a through hole space inside;

a first conducting element fastened and disposed in the through hole space, a front end of the first conducting element being conducted to a multi-frequency transmission element;

a frequency dividing element fastened and disposed in the through hole space and conducted to a rear end of the first conducting element, the frequency dividing element including a multi-frequency contacting end, a multi-frequency dividing circuit, a first frequency contacting end and a second frequency contacting end, one end of the multi-frequency dividing circuit being connected to the multi-frequency contacting end, the other end of the multi-frequency dividing circuit being branched to connect to both the first frequency contacting end and the second frequency contacting end so as to perform a signal transfer between frequency combining and frequency dividing for the multi-frequency contacting end in relation to the first frequency contacting end and the second frequency contacting end; and a second conducting element including a first coaxial cable and a second coaxial cable, one end of the first coaxial cable being connected to the first frequency contacting end, a first frequency connector being provided at the other end of the first coaxial cable, one end of the second coaxial cable being connected to the second frequency contacting end, and a second frequency connector being provided at the other end of the second coaxial cable.

2. The coaxial frequency-separating connector as claimed in claim 1, wherein the frequency of the first frequency contacting end and the frequency of the second frequency contacting end are 2.4 GHz and 5 GHz, respectively.

3. The coaxial frequency-separating connector as claimed in claim 1, wherein both front ends of the first conducting element and the sleeve element are formed with a universal RF connector selected one from a group comprising SMA, PR-SMA, Type-N-female, and PR-TNL-female connectors.

4. The coaxial frequency-separating connector as claimed in claim 2, wherein both front ends of the first conducting element and the sleeve element are formed with a universal RF connector selected one from a group comprising SMA, PR-SMA, Type-N-female, and PR-TNL-female connectors.

5. The coaxial frequency-separating connector as claimed in claim 1, wherein a threaded portion is formed on an external surface of a front end of the sleeve element.

6. The coaxial frequency-separating connector as claimed in claim 2, wherein a threaded portion is formed on an external surface of a front end of the sleeve element.

7. The coaxial frequency-separating connector as claimed in claim 1, wherein both the first frequency connector and the second frequency connector are board-side connectors selected from SMP, MCX, MMCX, U.FL, I-PEX and Mini-coaxial connectors.

8. The coaxial frequency-separating connector as claimed in claim 2, wherein both the first frequency connector and the second frequency connector are board-side connectors selected from SMP, MCX, MMCX, U.FL, I-PEX and Mini-coaxial connectors.

9. The coaxial frequency-separating connector as claimed in claim 1, wherein a front cushion and a rear retainer are provided on an external surface of a rear end of the sleeve element, the front cushion protruding in an axial direction of the sleeve element on a rear external surface of the sleeve element, the rear retainer being removable disposed at the sleeve element in a position relatively behind the front cushion, and a slot being formed between the front cushion and the rear retainer for pressing against a casing of a communication device so as to fix the sleeve element on the casing.

10. The coaxial frequency-separating connector as claimed in claim 2, wherein a front cushion and a rear retainer are provided on an external surface of a rear end of the sleeve element, the front cushion protruding in an axial direction of the sleeve element on a rear external surface of the sleeve element, the rear retainer being removable disposed at the sleeve element in a position relatively behind the front cushion, and a slot being formed between the front cushion and the rear retainer for pressing against a casing of a communication device so as to fix the sleeve element on the casing.

11. The coaxial frequency-separating connector as claimed in claim 1, wherein the front end of the first conducting element is a connecting terminal that conducts a frequency signal to a dual-frequency antenna.

12. The coaxial frequency-separating connector as claimed in claim 2, wherein the front end of the first conducting element is a connecting terminal that conducts a frequency signal to a dual-frequency antenna.

* * * * *